US009451811B2

(12) United States Patent
Sosnowski et al.

(10) Patent No.: US 9,451,811 B2
(45) Date of Patent: Sep. 27, 2016

(54) ADJUSTABLE FLOTATION DEVICE

(71) Applicants: Christopher John Sosnowski, Tempe, AZ (US); Cheryl Lynn Sosnowski, Tempe, AZ (US)

(72) Inventors: Christopher John Sosnowski, Tempe, AZ (US); Cheryl Lynn Sosnowski, Tempe, AZ (US)

( * ) Notice: Subject to any disclaimer, the term of this patent is extended or adjusted under 35 U.S.C. 154(b) by 0 days.

(21) Appl. No.: 14/639,835

(22) Filed: Mar. 5, 2015

(65) Prior Publication Data

US 2016/0052607 A1 Feb. 25, 2016

Related U.S. Application Data

(60) Provisional application No. 62/039,009, filed on Aug. 19, 2014.

(51) Int. Cl.

| | |
|---|---|
| ***B63B 35/73*** | (2006.01) |
| ***A44B 11/25*** | (2006.01) |
| ***A61H 37/00*** | (2006.01) |

(52) U.S. Cl.

CPC ..... *A44B 11/2592* (2013.01); *A61H 37/005* (2013.01)

(58) Field of Classification Search

CPC ..... B63B 35/73
USPC ..... 441/129–132
See application file for complete search history.

(56) References Cited

U.S. PATENT DOCUMENTS 728,745 A * 5/1903 Morrison ..... B63C 9/115 441/115
1,273,687 A * 7/1918 Stebbing ..... B63C 9/115 441/115
2,623,574 A * 12/1952 Wilhelm ..... A47C 1/146 297/1
5,273,473 A * 12/1993 Allen ..... B63B 7/06 114/219
5,324,221 A * 6/1994 Kaufman ..... A61H 37/005 441/129
5,411,425 A * 5/1995 Rinker ..... B63B 35/74 114/123
5,562,514 A * 10/1996 Rowe ..... A47C 15/006 441/129
5,746,632 A * 5/1998 Theberge ..... B63C 9/115 441/115
5,791,958 A * 8/1998 Yeung ..... B63B 35/74 441/130
6,132,276 A * 10/2000 Leemon ..... B63B 7/04 441/129
D636,452 S * 4/2011 Majors ..... D21/803
D728,050 S * 4/2015 Sosnowski ..... B63B 35/74 D21/803
9,051,032 B2 * 6/2015 Hanel ..... B63B 35/74
2008/0153370 A1 * 6/2008 Wagner ..... B63C 9/115 441/115
2014/0024273 A1 * 1/2014 Marcantonio ..... A47C 27/081 441/129

* cited by examiner

*Primary Examiner* — Lars A Olson
*Assistant Examiner* — Jovon Hayes

(57) ABSTRACT

An adjustable flotation device is a device that is utilized to support the user's body in a variety of supported positions when the user is floating in a body of water. The device features an upper support member and a lower support member that are connected by a first adjustable strap and a second adjustable strap. The lengths of the first adjustable strap and the second adjustable strap may be adjusted to allow the user to utilize the present invention in a variety of supported positions. An at least one upper flotation aid and a lower flotation aid are utilized in conjunction with the upper support member and the lower support member in order to provide buoyancy to the device when in water. The upper support member and the lower support member may be separated from the first adjustable strap and the second adjustable strap for portability and storage.

14 Claims, 8 Drawing Sheets

SECTION A-A

ADJUSTABLE FLOTATION DEVICE

The current application claims a priority to the U.S. Provisional Patent application Ser. No. 62/039,009 filed on Aug. 19, 2014.

FIELD OF THE INVENTION

The present invention relates generally to an apparatus for aiding the user in floating in a body of water. More specifically, the present invention is an adjustable flotation device that allows the user to float in a body of water in a variety of supported positions. The present invention may be utilized in recreational, therapeutic, and relaxation applications.

BACKGROUND OF THE INVENTION

Personal flotation devices are some of the most common recreational accessories found near pools, lakes, and similar bodies of water. Flotation devices come in many shapes and sizes and are designed to enhance the user's buoyancy. Recreational flotation devices include inflatable rafts, static foam rafts, floating bean bags, floating chairs, inner tubes, and large ridged pieces of foam. These various types of flotation devices are not without their drawbacks however. Inflatable devices must be inflated by using a pump or by blowing into a valve, a process that is often time-consuming and exhausting to the user. Popping is an ever-present concern with inflatable devices along with the possibility of air leakage through pinholes. Flotation devices composed of rigid or semi-rigid foam slab material result in a high center of gravity above the water, causing the user to tip or lose balance when lying or moving on top of the flotation device. Furthermore, these types of flotation devices are subject to wear and deterioration over time and are often expensive, bulky, and difficult to transport. In addition to the aforementioned issues relating to conventional flotation devices, these conventional flotation devices are rather limiting during use. The majority of the user's body is generally held above the water, reducing any effects of the water on the body and greatly reducing the user's body movement as a result. These flotation devices often lack versatility as the flotation devices are often limited to one type of usage or body position.

The present invention is an adjustable flotation device that is utilized to float in a body of water in various supported positions. The present invention may be adjusted by the user in order to provide the support necessary to reposition his or her body when floating in the water. The present invention allows the user to utilize his or her natural buoyancy in the water while remaining comfortably supported, eliminating the need for the user to use any muscles to remain floating. As such, the present invention may be used in therapeutic and relaxation applications due to the natural relaxed state of the body when utilizing the present invention. The present invention additionally requires minimal preparation prior to use.

DETAIL DESCRIPTIONS OF THE INVENTION

Figure 1:
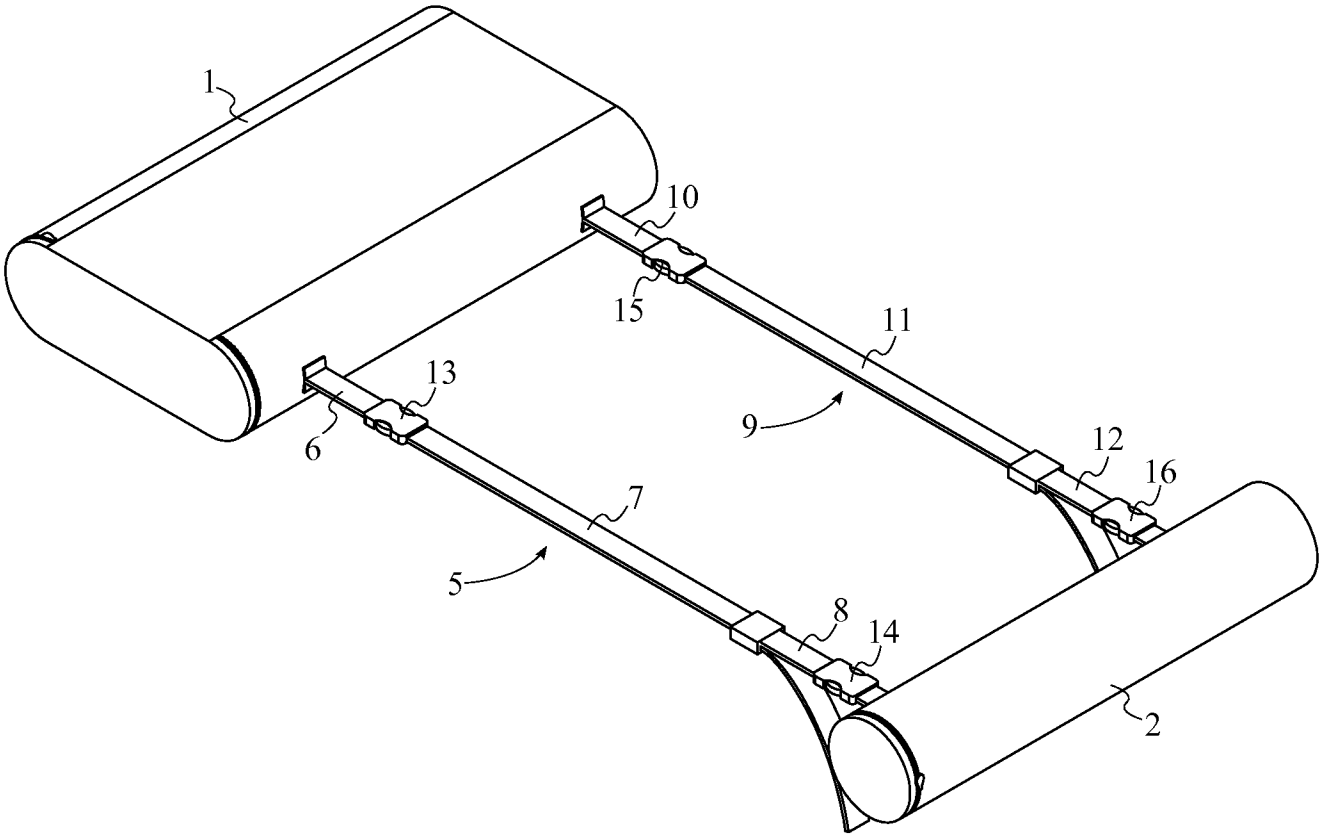
FIG. 1 is a perspective view of the present invention.
Figure 2:
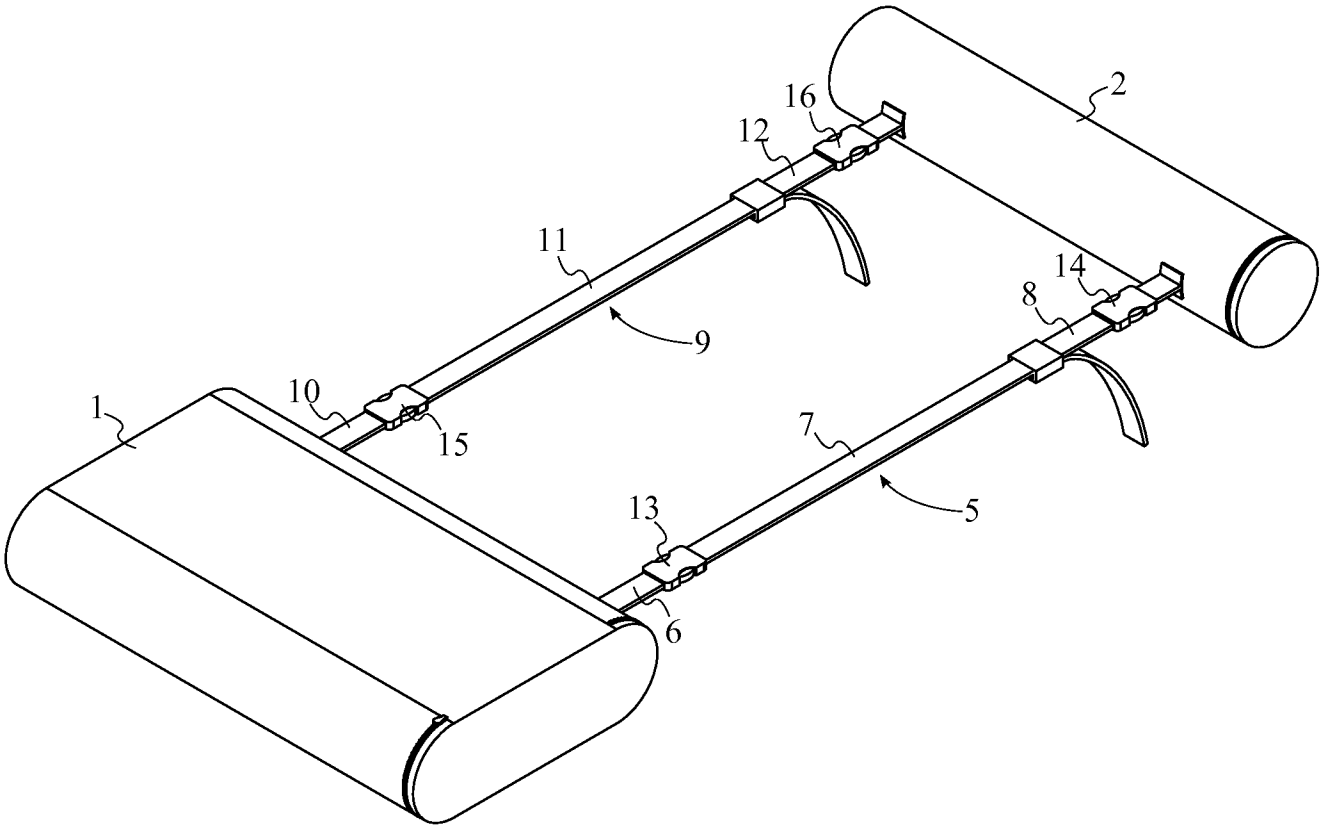
FIG. 2 is an additional perspective view of the present invention.
Figure 3:
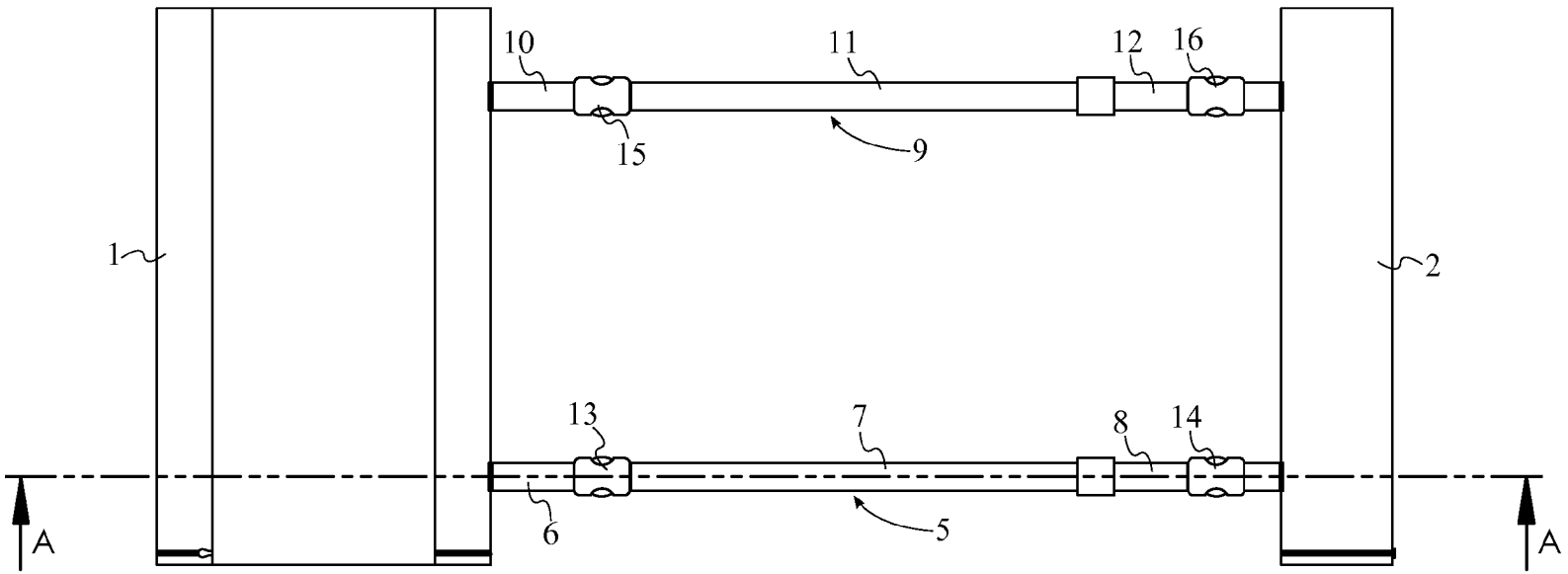
FIG. 3 is a top view of the present invention.

All illustrations of the drawings are for the purpose of describing selected versions of the present invention and are not intended to limit the scope of the present invention.

The present invention is an adjustable flotation device that allows the user to utilize the natural buoyancy of his or her body to float in a variety of supported positions. With reference to FIGS. 1-5, the present invention comprises an upper support member 1, a lower support member 2, at least one upper flotation aid 3, a lower flotation aid 4, a first adjustable strap 5, and a second adjustable strap 9.

The upper support member 1 is able to support an upper portion of the user's body such as the user's head or torso. Similarly, the lower support member 2 is able to support a lower portion of the user's body such as the user's legs or feet. The at least one upper flotation aid 3 and the lower flotation aid 4 are utilized in conjunction with the upper support member 1 and the lower support member 2, respectively. When the at least one upper flotation aid 3 and the lower flotation aid 4 are placed into water, the at least one upper flotation aid 3 and the lower flotation aid 4 are able to provide support to the user's body when the user is in the water. The first adjustable strap 5 and the second adjustable strap 9 are utilized to tether the upper support member 1 to the lower support member 2. Additionally, the first adjustable strap 5 and the second adjustable strap 9 allow the user to reposition the lower support member 2 relative to the upper support member 1 by increasing or decreasing the length of the first adjustable strap 5 and the second adjustable strap 9. This allows the user to float in multiple supported positions based on the positioning of the lower support member 2. The offset positioning of the lower support member 2 relative to the upper support member 1 allows the user's natural buoyancy and displacement of water to be utilized when floating. The second adjustable strap 9 is offset from the first adjustable strap 5 in order to position the user's body in between the first adjustable strap 5 and the second adjustable strap 9 during use of the present invention.

In the preferred embodiment of the present invention, the at least one upper flotation aid 3 and the lower flotation aid 4 are composed of inherently buoyant material such as, but not limited to, closed cell foam or an inflatable flotation device. This minimizes the need to inflate or otherwise prepare the at least one upper flotation aid 3 and the lower flotation aid 4 prior to use of the present invention.

Figure 4:
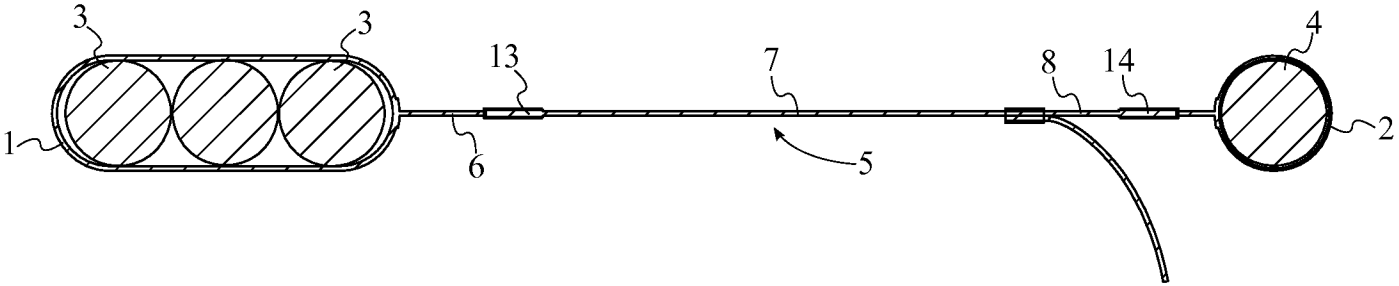
FIG. 4 is a cross-sectional view of the present invention taken along line A-A of FIG. 3.
Figure 5:
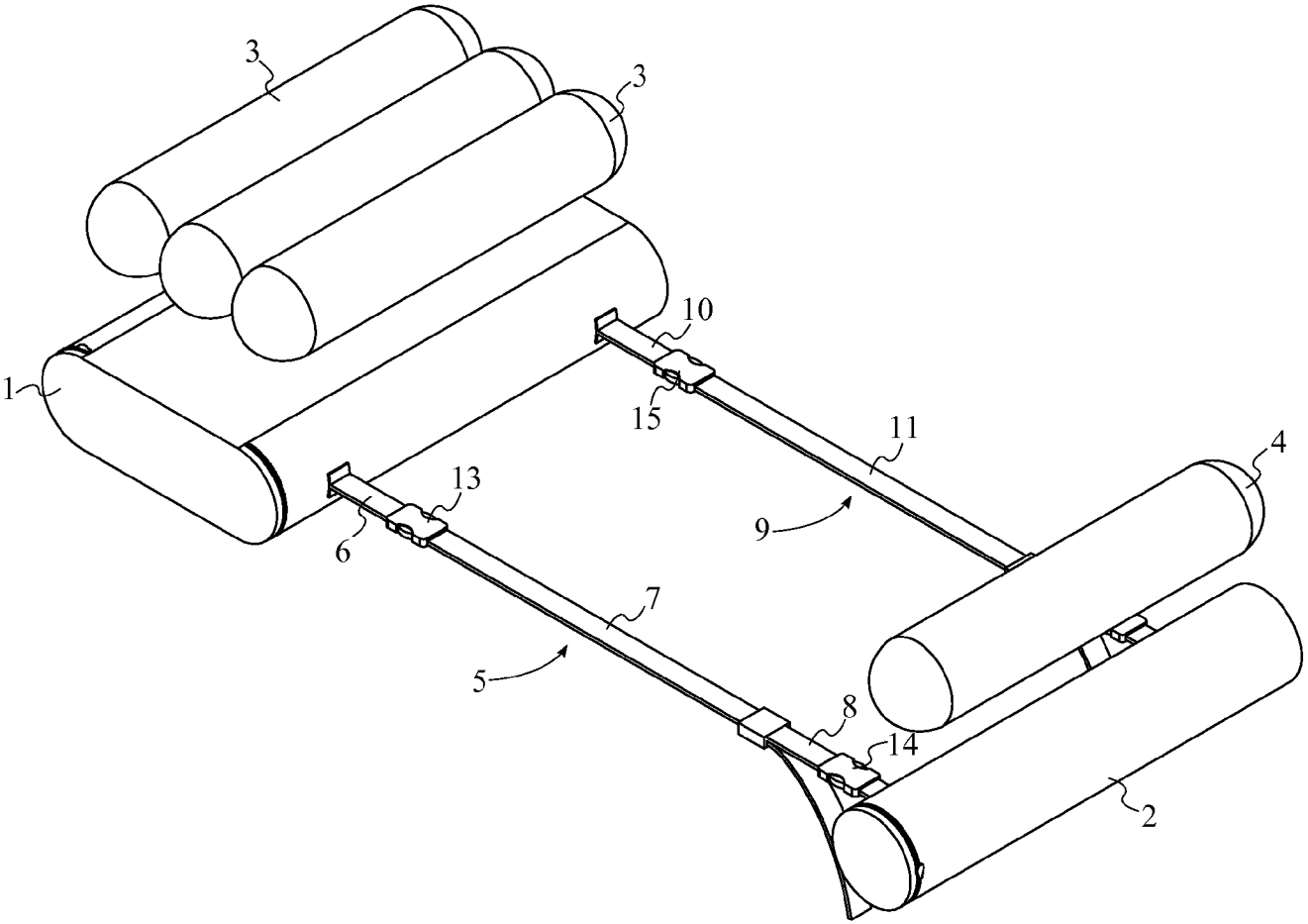
FIG. 5 is a perspective view of the present invention with the at least one upper flotation aid and the lower flotation aid removed from the upper support member and the lower support member.

As shown in FIG. 4, the at least one upper flotation aid 3 is positioned within the upper support member 1 while the lower flotation aid 4 is positioned within the lower support member 2. This prevents the at least one upper flotation aid 3 and the lower flotation aid 4 from separating from the present invention during use. The at least one upper flotation aid 3 and the lower flotation aid 4 are shown removed from the upper support member 1 and the lower support member 2 in FIG. 5. In the preferred embodiment of the present invention, the lower support member 2 is a housing sleeve that is able to securely hold the lower flotation aid 4 within the lower support member 2 (for example, via a zipper mechanism). The upper support member 1, the at least one upper flotation aid 3, the lower support member 2, and the lower flotation aid 4 are able to keep an upper portion and a lower portion of the user's body comfortably supported above the water. This allows the natural buoyancy and water displacement of the remainder of the user's body to create a sense of muscle relaxation as well as a feeling of floating weightlessly. The upper support member 1 is releasably attached to the first adjustable strap 5 and the second adjustable strap 9. Similarly, the lower support member 2 is releasably attached to the first adjustable strap 5 and the second adjustable strap 9, opposite to the upper support member 1. The releasable nature of these attachments allows the upper support member 1 to be separated from the lower support member 2 as needed, such as during storage of the present invention.

The first adjustable strap 5 comprises a first upper portion 6, a first adjustable portion 7, and a first lower portion 8. The first upper portion 6 is the portion of the first adjustable strap 5 that is positioned adjacent to the upper support member 1. As such, the first upper portion 6 is adjacently connected to the upper support member 1 and is not adjustable in length. The first adjustable portion 7 is the portion of the first adjustable strap 5 that is adjustable in terms of length. The first adjustable portion 7 is releasably attached to the first upper portion 6, opposite to the upper support member 1. This allows the upper support member 1 and the first upper portion 6 to be separated from the first adjustable portion 7 as needed. The first lower portion 8 is the portion of the first adjustable strap 5 that is positioned adjacent to the lower support member 2. As such, the lower support member 2 is adjacently connected to the first lower portion 8, opposite to the first adjustable portion 7. The first lower portion 8 is not adjustable in length. Similar to the first upper portion 6, the first adjustable portion 7 is releasably attached to the first lower portion 8, opposite to the first upper portion 6. This allows the lower support member 2 and the first lower portion 8 to be separated from the first adjustable portion 7 as needed.

The present invention further comprises a first quick-release upper buckle 13 and a first quick-release lower buckle 14. The first quick-release upper buckle 13 allows the upper support member 1 and the first upper portion 6 to be separated from the first adjustable portion 7. Similarly, the first quick-release lower buckle 14 allows the lower support member 2 and the first lower portion 8 to be separated from the first adjustable portion 7. As such, the first quick-release upper buckle 13 is connected in between the first adjustable portion 7 and the first upper portion 6. This allows the user to secure the upper support member 1 and the first upper portion 6 to the first adjustable portion 7 by engaging the first quick-release upper buckle 13. Disengaging the first quick-release upper buckle 13 allows the user to separate the upper support member 1 and the first upper portion 6 from the first adjustable portion 7. The first quick-release lower buckle 14 is connected in between the first adjustable portion 7 and the first lower portion 8. Similar to the first quick-release upper buckle 13, the first quick-release lower buckle 14 may be engaged in order to join the lower support member 2 and the first lower portion 8 to the first adjustable portion 7. The first quick-release lower buckle 14 is disengaged in order to separate the lower support member 2 and the first lower portion 8 from the first adjustable portion 7.

The second adjustable strap 9 is identical to the first adjustable strap 5 in terms of functionality. The second adjustable strap 9 comprises a second upper portion 10, a second adjustable portion 11, and a second lower portion 12. The second upper portion 10 is the portion of the second adjustable strap 9 that is positioned adjacent to the upper support member 1. As with the first upper portion 6, the second upper portion 10 is not adjustable in length. The second upper portion 10 is releasably attached to the second adjustable portion 11, allowing the upper support member 1 and the second upper portion 10 to be separated from the second adjustable portion 11 as needed. Similar to the first lower portion 8, the second lower portion 12 is the portion of the second adjustable strap 9 that is positioned adjacent to the lower support member 2 and is not adjustable in length. The second lower portion 12 is adjacently connected to the lower support member 2, opposite to the second adjustable portion 11. The second lower portion 12 is releasably attached to the second adjustable portion 11, opposite to the second upper portion 10. As such, the lower support member 2 and the second lower portion 12 may be separated from the second adjustable portion 11 as needed.

The present invention further comprises a second quick-release upper buckle 15 and a second quick-release lower buckle 16. The second quick-release upper buckle 15 and the second quick-release lower buckle 16 are functionally identical to the first quick-release upper buckle 13 and the first quick-release lower buckle 14. The second quick-release upper buckle 13 is connected in between the second adjustable portion 11 and the second upper portion 10. This allows the second quick-release upper buckle 13 to be engaged when joining the upper support member 1 and the second upper portion 10 to the second adjustable portion 11. The second quick-release upper buckle 13 is disengaged in order to separate the upper support member 1 and the second upper portion 10 from the second adjustable portion 11. The second quick-release lower buckle 16 is connected in between the second adjustable portion 11 and the second lower portion 12. The second quick-release lower buckle 16 is engaged in order to join the lower support member 2 and the second lower portion 12 to the second adjustable portion 11. Conversely, the second quick-release lower buckle 16 is disengaged to separate the lower support member 2 and the second lower portion 12 from the second adjustable portion 11.

In the preferred embodiment of the present invention shown in FIGS. 1-5, the upper support member 1 is a casing. The at least one upper flotation aid 3 is enveloped by the casing in order to prevent the at least one upper flotation aid 3 from separating from the upper support member 1 during use of the present invention. The casing is able to securely hold the at least one upper flotation aid 3 in place within the upper support member 1 (for example, via a zipper mechanism).

Figure 6:
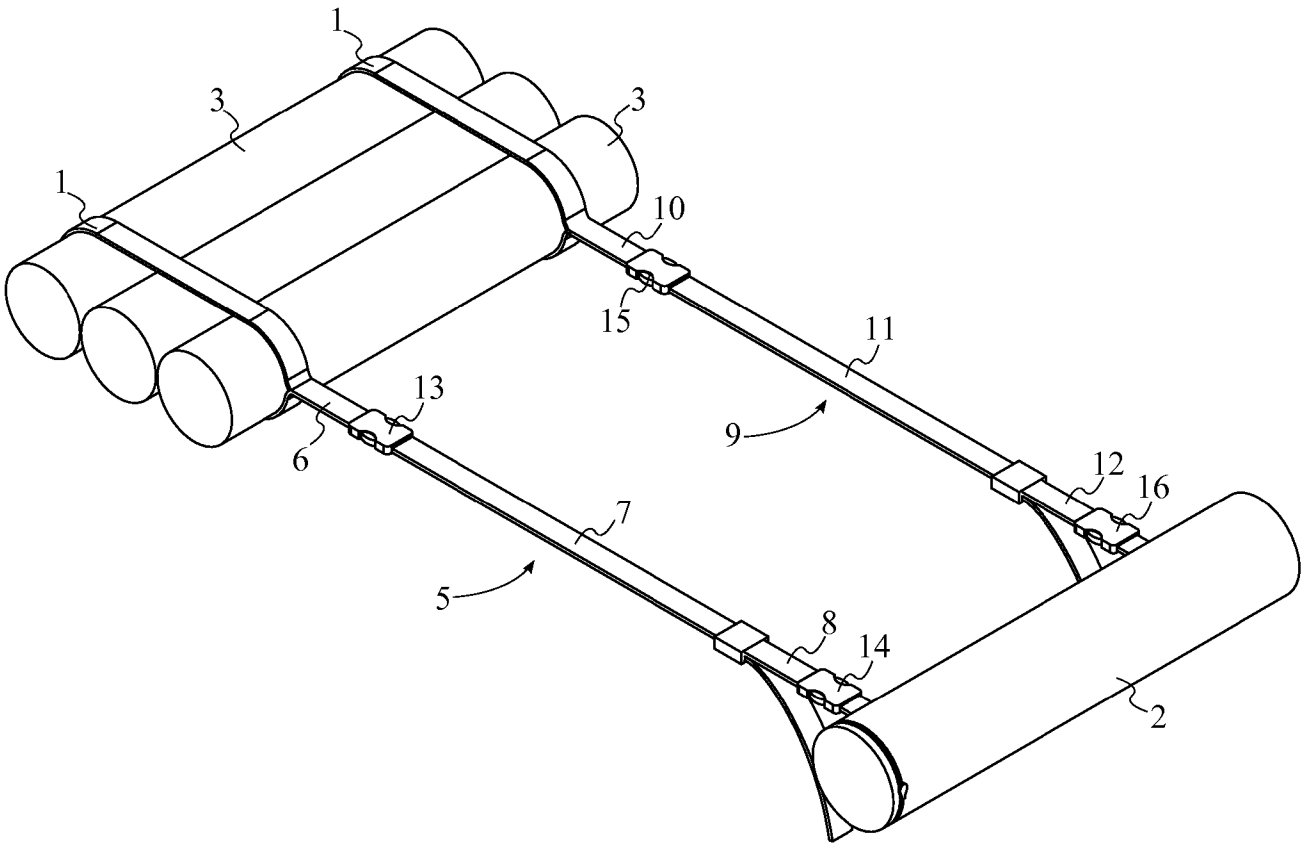
FIG. 6 is a perspective view of an alternative embodiment of the present invention.
Figure 7:
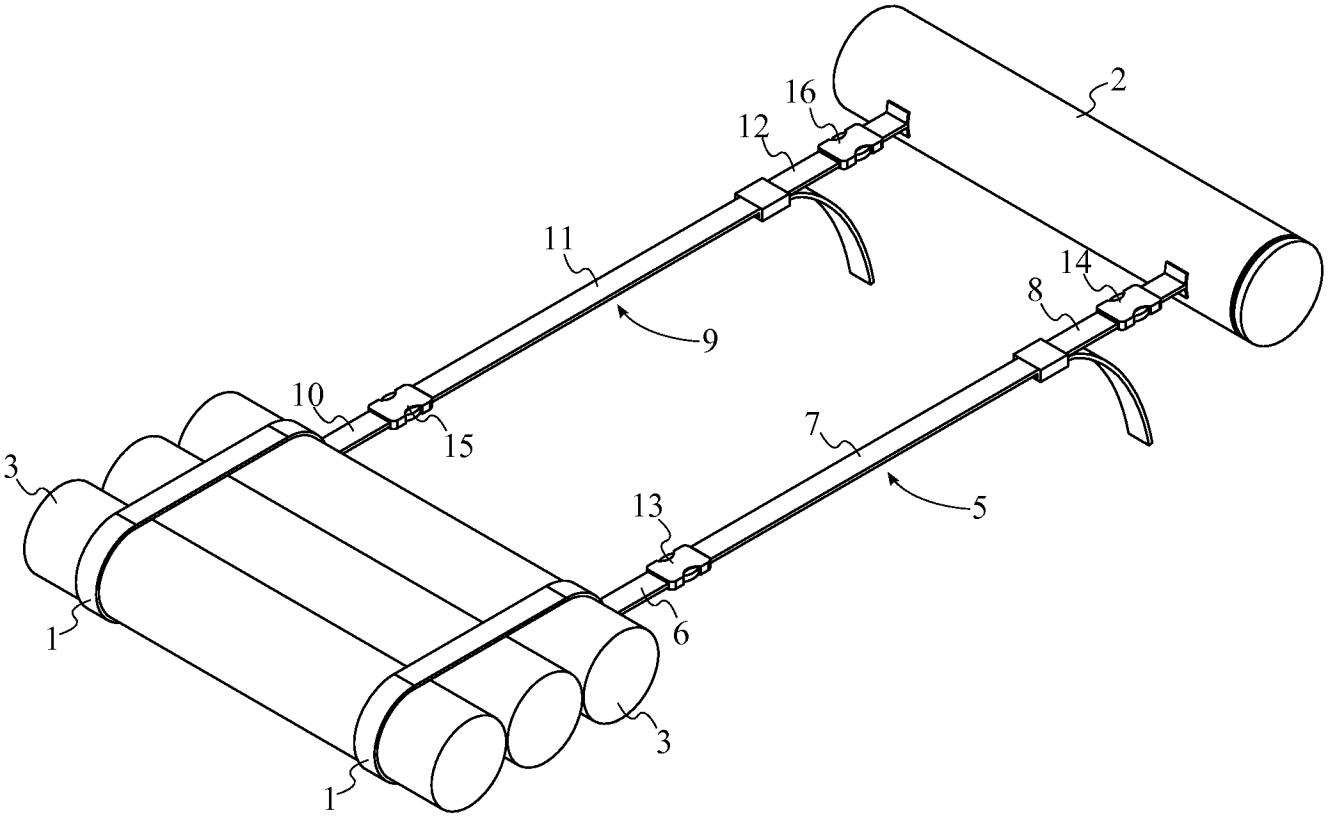
FIG. 7 is an additional perspective view of the alternative embodiment of the present invention.

An alternative embodiment of the present invention is shown in FIG. 6 and FIG. 7. In the alternative embodiment of the present invention, the upper support member 1 is a pair of straps. The at least one upper flotation aid 3 is wrapped by the pair of straps. This prevents the at least one upper flotation aid 3 from separating from the upper support member 1 without compromising the ability of the at least one upper flotation aid 3 to provide support for an upper portion of the user's body.

Figure 8:
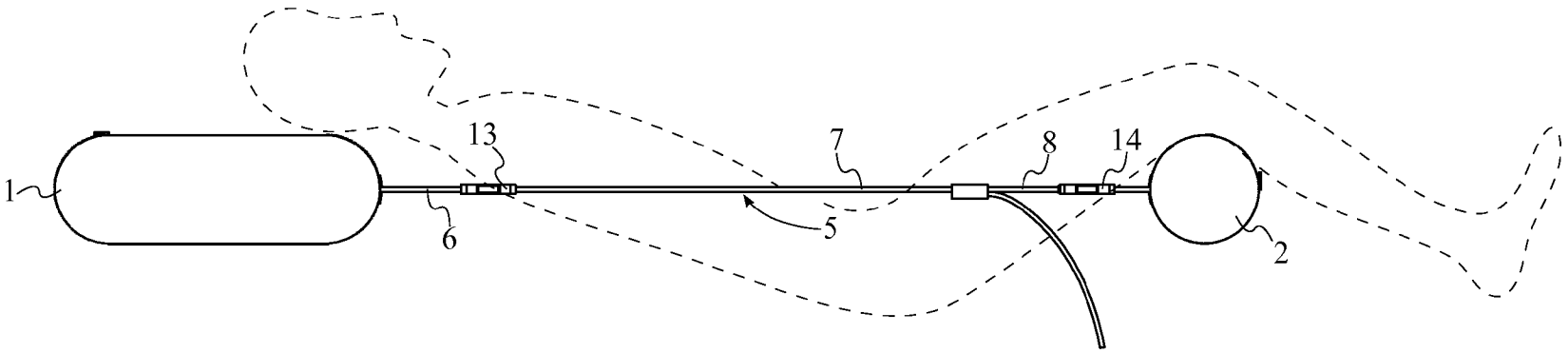
FIG. 8 is a side view of the present invention demonstrating a user being supported by the present invention.

The object of the present invention is to support the user's body when the user is floating in a body of water, in conjunction with the user's natural buoyancy and water displacement. The upper support member 1 and the lower support member 2 are able to support an upper portion and lower portion of the user's body as shown in FIG. 8. The present invention is highly versatile and may be utilized in a variety of supported positions including:

1. Supine fully reclined position with the lower support member 2 fully extended to support the user's feet
2. Supine fully reclined position with the lower support member 2 positioned to support the user's knees
3. Seated position with the lower support member 2 positioned beneath the buttocks in order to form a chair
4. Prone positioned with the lower support member 2 positioned directly adjacent to the upper support member 1 in order to support the head and torso The present invention is versatile due to its recreational, therapeutic, and relaxation applications due to the enhanced feelings of stress-relief brought upon by the natural relaxed state of the body when the user is floating and supported by the present invention.

Although the present invention has been explained in relation to its preferred embodiment, it is understood that many other possible modifications and variations can be made without departing from the spirit and scope of the present invention as hereinafter claimed.

What is claimed is:

1. An adjustable flotation device comprises:
an upper support member;
a lower support member;
at least one upper flotation aid;
a lower flotation aid;
a first adjustable strap;
a second adjustable strap being offset from the first adjustable strap;
the at least one upper flotation aid being positioned within the upper support member;
the lower flotation aid being positioned within the lower support member;
the upper support member being releasably attached to the first adjustable strap and the second adjustable strap; and
the lower support member being releasably attached to the first adjustable strap and the second adjustable strap, opposite to the upper support member.

2. The adjustable flotation device as claimed in claim 1 further comprises:
the first adjustable strap comprises a first upper portion, a first adjustable portion, and a first lower portion;
the first upper portion being adjacently connected to the upper support member;
the first adjustable portion being releasably attached to the first upper portion, opposite to the upper support member;
the lower support member being adjacently connected to the first lower portion, opposite to the first adjustable portion; and
the first adjustable portion being releasably attached to the first lower portion, opposite to the first upper portion.

3. The adjustable flotation device as claimed in claim 2 further comprises:
a first quick-release upper buckle;
a first quick-release lower buckle;
the first quick-release upper buckle being connected in between the first adjustable portion and the first upper portion; and
the first quick-release lower buckle being connected in between the first adjustable portion and the first lower portion.

4. The adjustable flotation device as claimed in claim 1 further comprises:
the second adjustable strap comprises a second upper portion, a second adjustable portion, and a second lower portion;
the second upper portion being adjacently connected to the upper support member;
the second adjustable portion being releasably attached to the second upper portion, opposite to the upper support member;
the lower support member being adjacently connected to the second lower portion, opposite to the second adjustable portion; and
the second lower portion being releasably attached to the second adjustable portion, opposite to the second upper portion.

5. The adjustable flotation device as claimed in claim 4 further comprises:
a second quick-release upper buckle;
a second quick-release lower buckle;
the second quick-release upper buckle being connected in between the second adjustable portion and the second upper portion; and
the second quick-release lower buckle being connected in between the second adjustable portion and the second lower portion.

6. The adjustable flotation device as claimed in claim 1, wherein the lower support member is a housing sleeve.

7. The adjustable flotation device as claimed in claim 1 further comprises:
the upper support member being a casing; and
the at least one upper flotation aid being enveloped by the casing.

8. The adjustable flotation device as claimed in claim 1 further comprises:
the upper support member being a pair of straps; and
the at least one upper flotation aid being wrapped by the pair of straps.

9. An adjustable flotation device comprises:
an upper support member;
a lower support member;
at least one upper flotation aid;
a lower flotation aid;
a first adjustable strap;
a second adjustable strap being offset from the first adjustable strap;
the first adjustable strap comprises a first upper portion, a first adjustable portion, and a first lower portion;
the second adjustable strap comprises a second upper portion, a second adjustable portion, and a second lower portion;
the at least one upper flotation aid being positioned within the upper support member;
the lower flotation aid being positioned within the lower support member;
the upper support member being releasably attached to the first adjustable strap and the second adjustable strap;
the lower support member being releasably attached to the first adjustable strap and the second adjustable strap, opposite to the upper support member;
the first upper portion being adjacently connected to the upper support member;
the first adjustable portion being releasably attached to the first upper portion, opposite to the upper support member;

the lower support member being adjacently connected to the first lower portion, opposite to the first adjustable portion;

the first adjustable portion being releasably attached to the first lower portion, opposite to the first upper portion;

the second upper portion being adjacently connected to the upper support member;

the second adjustable portion being releasably attached to the second upper portion, opposite to the upper support member;

the lower support member being adjacently connected to the second lower portion, opposite to the second adjustable portion; and the second lower portion being releasably attached to the second adjustable portion, opposite to the second upper portion.

10. The adjustable flotation device as claimed in claim 9 further comprises:

a first quick-release upper buckle;

a first quick-release lower buckle;

the first quick-release upper buckle being connected in between the first adjustable portion and the first upper portion; and the first quick-release lower buckle being connected in between the first adjustable portion and the first lower portion.

11. The adjustable flotation device as claimed in claim 9 further comprises:

a second quick-release upper buckle;

a second quick-release lower buckle;

the second quick-release upper buckle being connected in between the second adjustable portion and the second upper portion; and the second quick-release lower buckle being connected in between the second adjustable portion and the second lower portion.

12. The adjustable flotation device as claimed in claim 9, wherein the lower support member is a housing sleeve.

13. The adjustable flotation device as claimed in claim 9 further comprises:

the upper support member being a casing; and the at least one upper flotation aid being enveloped by the casing.

14. The adjustable flotation device as claimed in claim 9 further comprises:

the upper support member being a pair of straps; and the at least one upper flotation aid being wrapped by the pair of straps.

* * * * *